US007356870B2

(12) United States Patent
VanHulzen

(10) Patent No.: US 7,356,870 B2
(45) **Date of Patent: *Apr. 15, 2008**

(54) WATER PIPE CLEANING APPARATUS AND METHOD

(76) Inventor: Chad VanHulzen, 213 W. Fairfield Ct., Palatine, IL (US) 60067

( * ) Notice: Subject to any disclaimer, the term of this patent is extended or adjusted under 35 U.S.C. 154(b) by 415 days.

This patent is subject to a terminal disclaimer.

(21) Appl. No.: 10/921,652

(22) Filed: Aug. 19, 2004

(65) Prior Publication Data

US 2006/0037164 A1 Feb. 23, 2006

(51) Int. Cl.
*A47L 1/12* (2006.01)
*A47L 1/03* (2006.01)
*A47L 1/09* (2006.01)

(52) U.S. Cl. ..... 15/220.2; 15/59; 119/264

(58) Field of Classification Search ..... 15/220.2, 15/20.1, 210.1, 59; 119/264
See application file for complete search history.

(56) References Cited

U.S. PATENT DOCUMENTS 3,208,090 A * 9/1965 Roesel, Jr. ..... 15/220.2
4,111,214 A * 9/1978 Flesher ..... 131/173
4,116,204 A * 9/1978 Kline ..... 131/173
4,148,327 A * 4/1979 Graham ..... 131/173
4,183,365 A * 1/1980 Kelley ..... 131/180
4,216,785 A * 8/1980 Erickson et al. ..... 131/173
4,241,741 A * 12/1980 Cabados et al. ..... 131/173
4,253,475 A * 3/1981 Schreiber et al. ..... 131/173
D349,780 S * 8/1994 Heine ..... D27/162
5,476,110 A * 12/1995 Baig et al. ..... 131/173
D368,325 S * 3/1996 Heine ..... D27/162
D368,551 S * 4/1996 Richards ..... D27/162
5,515,570 A 5/1996 Muscroft
D381,116 S * 7/1997 Richards ..... D27/162
D403,106 S * 12/1998 Barmes ..... D27/162
5,988,109 A 11/1999 Rofen
6,206,978 B1 3/2001 Tsui
6,284,056 B1 9/2001 Gonzalez
6,348,104 B1 * 2/2002 Bakker ..... 134/6
D466,259 S 11/2002 Wang
D470,284 S 2/2003 Vega
6,634,052 B2 10/2003 Hanson
2003/0217422 A1 11/2003 Tsai

* cited by examiner

*Primary Examiner*—Shay Karls
(74) *Attorney, Agent, or Firm*—Valauskas & Pine LLC

(57) ABSTRACT

The present invention is a method and apparatus for cleaning the surfaces of a water pipe. The present invention includes a major unit and a minor unit that are magnetically coupled. The pipe cleaning apparatus cleans the surfaces of a water pipe as it is moved in conjunction (maintaining a magnetic connection) along the inside and outside surfaces of the pipe. The cleaning apparatus efficiently and effectively cleans the residue that builds up on the inside surfaces of a tobacco pipe, but also provides entertainment.

4 Claims, 3 Drawing Sheets

WATER PIPE CLEANING APPARATUS AND METHOD

FIELD OF THE INVENTION

The present invention relates generally to tobacco pipes, and more particularly to water pipes of the type in which the smoke is passed from the tobacco bowl through a liquid containing reservoir and thence to the mouth of the user. Most particularly, the invention relates to an apparatus and method for cleaning tobacco pipes or water pipes.

BACKGROUND OF THE INVENTION

Residue typically builds up within the tobacco pipe from use. This residue is unsanitary, may damage the tobacco pipe, appear aesthetically unpleasing, as well as alter the smoking experience, thus, it is often necessary to clean the inside surfaces of the tobacco pipe. Tobacco pipes of the kind the present invention relates come in a variety of sizes, shapes, and composition. Reference can be made to the following U.S. Pat. Nos.: D349,780; D368,325; D368,551; D381,116; D403,106; 4,111,214; 4,116,204; 4,148,327; 4,183,365; 4,216,785; 4,241,741; 4,253,475; 5,476,110.

Cleaning solutions can be used, but are often insufficient and may be hazardous. Thus, there is a need for a cleaning apparatus and method that efficiently and effectively cleans the residue that may build up on the inside surfaces of a tobacco pipe, but that can also provide entertainment.

SUMMARY OF THE INVENTION

The present invention is a two piece magnetically coupled apparatus that efficiently and effectively cleans the surfaces of a tobacco pipe or water pipe. The present invention removes residue from water pipes constructed of any composition, for example glass, Plexiglas, ceramic, clay, porcelain and plastic. Tobacco pipe and water pipe are used interchangeably herein.

The present invention includes a major unit and a minor unit that are magnetically coupled. An aspect of the present invention is to clean the surfaces of a tobacco pipe as the major unit and minor unit are moved along the surfaces of the water pipe maintaining the magnetic connection. The major unit is positioned on the outside surface of a water pipe while the minor unit is positioned on the inside surface of the water pipe.

An object of the present invention is to provide a textured element on the minor unit for cleaning the surfaces of a water pipe. The textured element can be a material that scrapes or scrubs the residue off or away from the surfaces of the water pipe. The textured element can be a separate element that is attached to a surface of the minor unit (positioned on the inside surface of the water pipe), for example, VELCRO®, felt or rough fibers. The textured element may also be integrated with the minor unit, for example, a beveled surface, raised channels or continuous peaks and valleys.

It is further contemplated the end of the minor unit positioned on the inside surface of the water pipe may be rounded or convex to effectively clean residue of contoured features of the water pipe, for example corners, arched or curved surfaces.

A further object of the present invention is to provide an ergonomically designed pipe cleaning apparatus for easy manipulation. The major unit acts as a handle. It has circular cross section that is tapered from a first end to a second end, although any shaped cross section is contemplated. Further, the first end of the major unit could extend to the second end. Taper is to become gradually narrower or thinner and extend is to elongate or lengthen in a straight fashion.

Yet another object of the present invention is to provide a container, receptacle or compartment positioned within the major unit for placing and storing items, for example tobacco.

The present invention will be further appreciated, and its attributes and advantages further understood, with reference to the detailed description below of some presently contemplated embodiments, taken in conjunction with the accompanying drawings, in which:

DETAILED DESCRIPTION OF EMBODIMENTS OF THE INVENTION

The present invention is a cleaning apparatus and method that efficiently and effectively cleans the residue that may build up on the inside surface of a tobacco pipe. A major unit 12 and a minor unit 22 (FIG. 1) are magnetically coupled such that the surfaces of a water pipe are cleaned when the major unit 12 and minor unit 22 are moved along the surface of a pipe.

Figure 1:
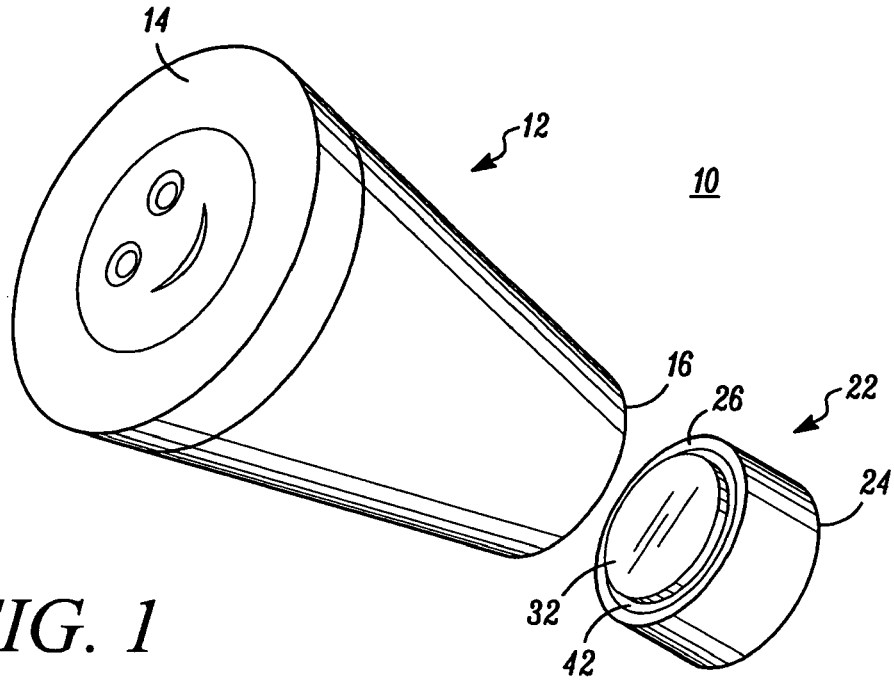
FIG. 1 is a perspective view of an assembled pipe cleaning apparatus made in accordance with certain aspects of the invention.

As shown in FIG. 1, the cleaning apparatus 10 includes a major unit 12 and a minor unit 22. The major unit 12 and minor unit 22 are composed of plastic, but any material is contemplated, for example, metal. The major unit longitudinally extends from a first end 14 to a second end 16 creating a substantially cylindrical shape. The first end 14 may be tapered to the second end 16 providing for a wide cross section at the first end 14 narrowing to a smaller cross section at the second end 16 (FIG. 1).

The minor unit 22 longitudinally extends from a first end 24 to a second end 26 creating a cylindrical shape. The second end 26 may be slightly bowed or convex to effectively clean residue of contoured features of a water pipe, for example comers, arched or curved surfaces. Further, a textured element 32 is disposed on the second end 26. The textured element 32 can be a separate element, such as VELCRO®, felt or rough fibers, disposed on the surface of the second end 26. The textured element 32 has adhesive 42 on the opposite side thereof that mounts to the second end 26. Further, the textured element 32 can be integrated with the minor unit, for example, a beveled surface, raised channels or continuous peaks and valleys.

Figure 2:
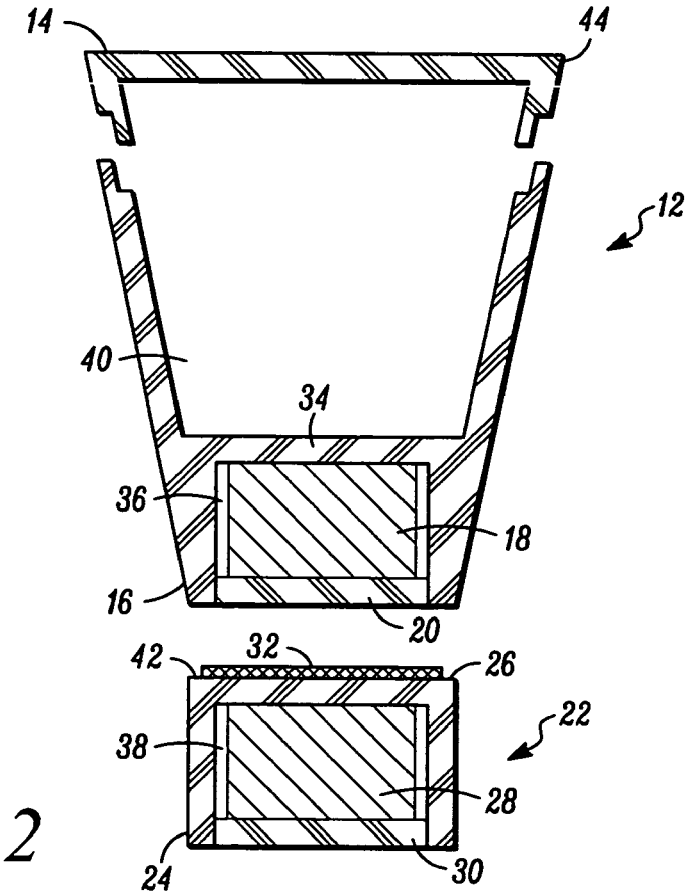
FIG. 2 is a cross sectional view of a pipe cleaning apparatus made in accordance with this invention.

In reference to FIG. 2, the major unit 12 includes a top cap 44 at the first end 14. The top cap 44 is removeably connected to the major unit 12. The removable connection can, for example, be a snap fit, interference fit or a threaded arrangement for easy assembly and disassembly.

The top cap 44 creates a receptacle 40 when assembled. The receptacle 40 is formed by the top cap 44 opposing a separator 34 and the longitudinally extending walls of the major unit 12. The separator extends longitudinally across the cross section of the major unit 12. The separator 34 is integrated with the major unit 12 and is composed of the same material. The receptacle 40 can be used to for placing and storing items such as tobacco. The receptacle 40 can be of any size or shape.

The separator 34 not only forms an aspect of the receptacle 40, but also forms an aspect of a cavity 36 for receiving a master magnet 18. A master magnet 18 is positioned in a first cavity 36 at the second end 16 to rest substantially near the separator 34. A first end cap 20 secures the master magnet 18 in the first cavity 36.

The minor unit 22 includes a second cavity 38. A slave magnet 28 is positioned in the second cavity 38 and secured by a second end cap 30. A textured element 32 covers the second end 26 of the minor unit 22. The textured element 32 can be any material or arrangement such that is removes residue from a water pipe. In the preferred embodiment, the textured element 32 is a VELCRO® pad of the size and shape to cover the second end 26. The VELCRO® pad includes an adhesive 42 that bonds the pad to the second end 26 of the minor unit 22.

Figure 3:
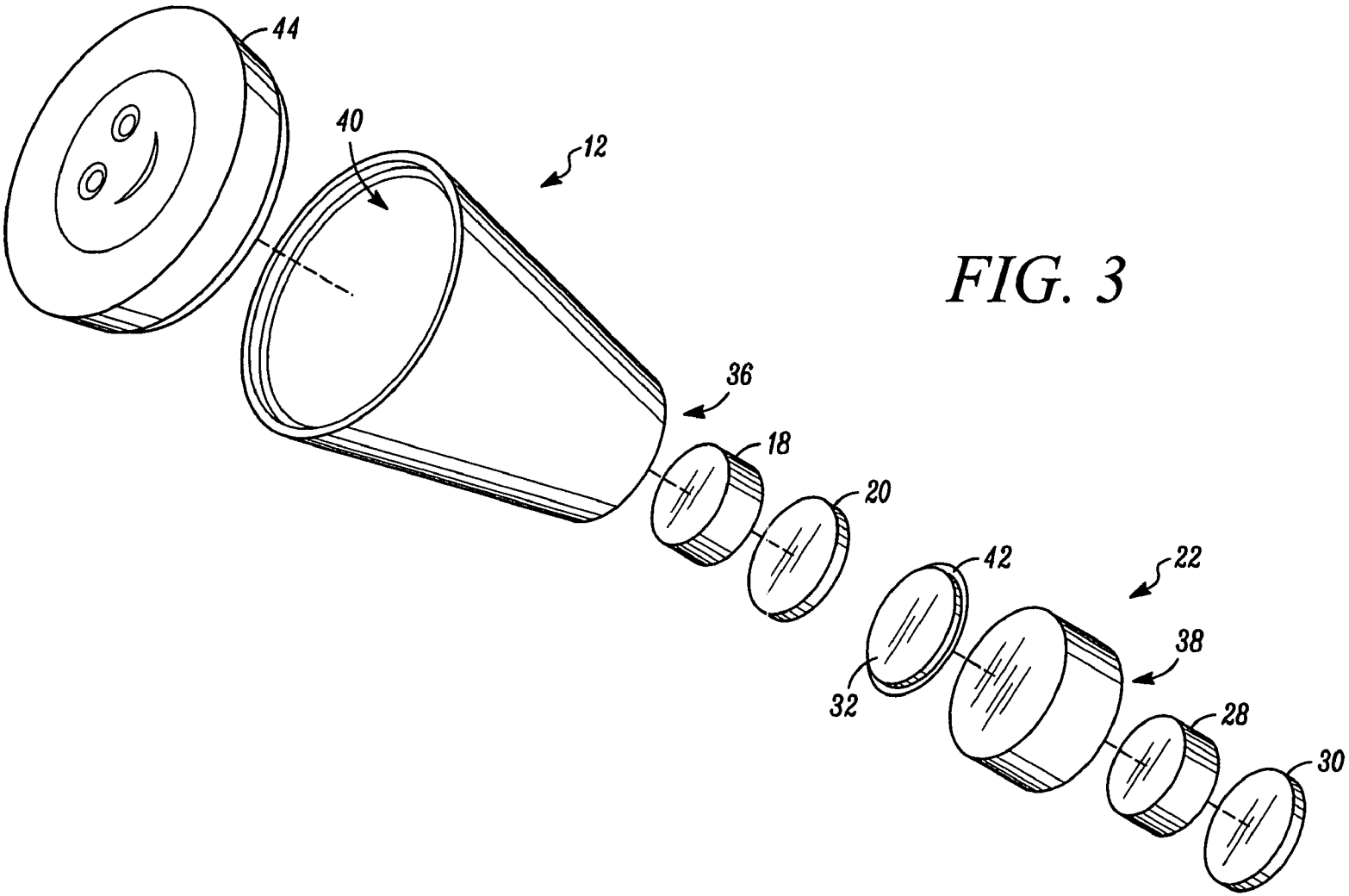
FIG. 3 is an exploded view of a pipe cleaning apparatus made in accordance with this invention.

Referring to FIG. 3, the first cavity 36 receives a master magnet 18. The master magnet 18 is positioned such that it is substantially near the separator 34. A first end cap 20 is positioned at the second end 16 to secure the master magnet 18 in the first cavity 36. The second end cap 20 can be a snap fit to the second end 16 or secured by glue. The top cap 44 is assembled at the first end 14 to complete receptacle 40.

The second cavity 38 receives a slave magnet 28. A second end cap 30 is positioned at the first end 24 to secure the slave magnet 28 in the second cavity 38. The second end cap 30 can be a snap fit to the first end 24 or glued to secure the slave magnet 28 in the cavity 38. Adhesive 42 attaches the textured element 32 to the minor unit 22, although any attachment means is contemplated.

Master magnet 18 and slave magnet 28 are fields with the property, either natural or induced, of attraction. The master magnet 18 and slave magnet 28 are coupled when the fields are attracted.

Figure 4:
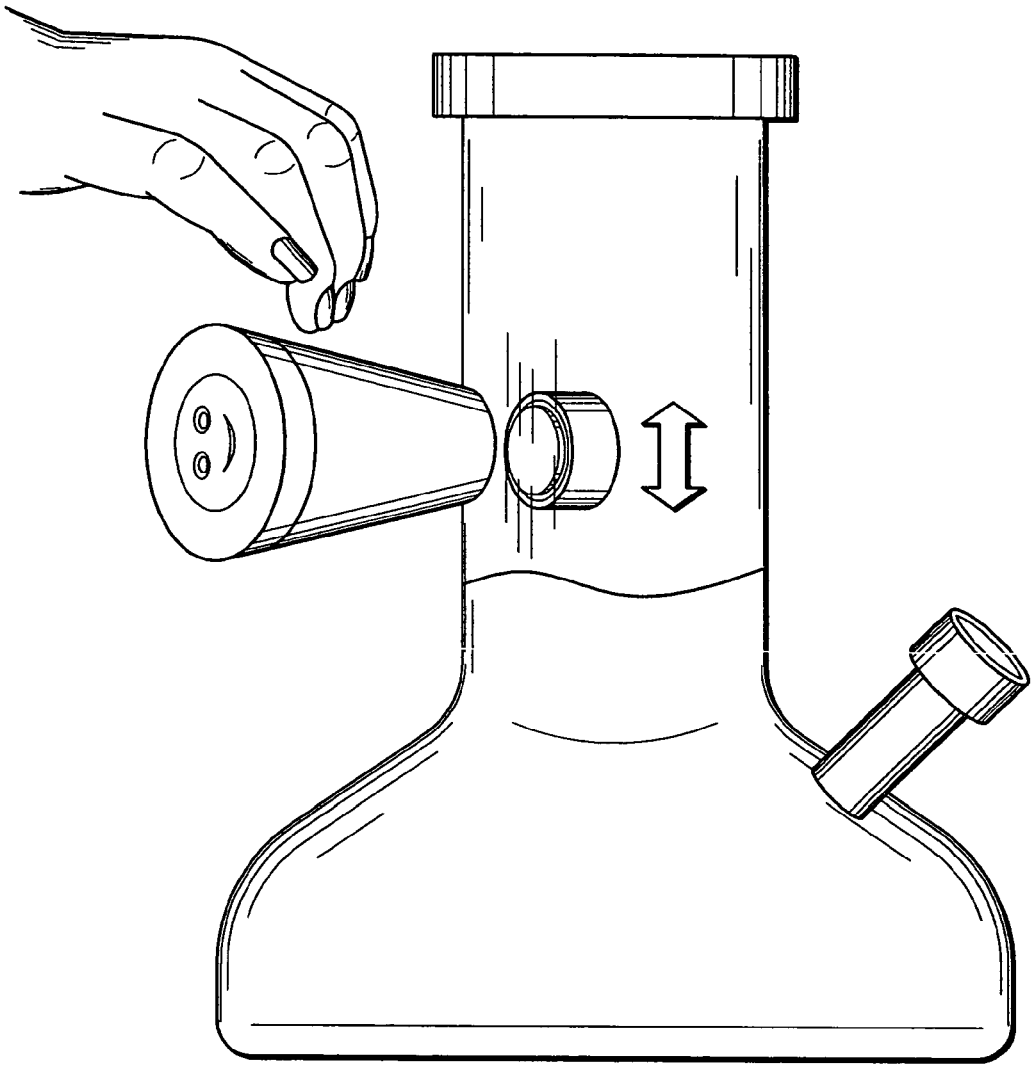
FIG. 4 is a perspective view of a pipe cleaning apparatus and water pipe.

The present invention cleans the inside surface of water pipe (FIG. 4). The second end 16 with first end cap 20 of the major unit 12 is positioned on the outside surface of a water pipe and the textured element 32 of the second end 26 of the minor unit 22 is positioned on the inside surface of the water pipe. The cylindrical shape of the major unit 14 provides a lever for a user to grasp onto and move the major unit 14.

The textured element 32 on the second end 26 of the minor unit 22 cleans the inside surface of a water pipe as the major unit 12 is moved along the outside surface of the water pipe. As the major unit 12 is moved along the outside surface of the water pipe, the magnetic connection between the major unit 12 and minor unit 22 causes the minor unit 22 to move along the inside surface of the water pipe in conjunction with the major unit 12. The textured element 32 scrapes or scrubs the residue off or away from the inside surface of the water pipe. Further, the textured element 32 may be disposed on a bowed or convex second end 26. The convex shape of the second end 26 effectively cleans residue of contoured features of the water pipe, for example comers, arched or curved surfaces.

Thus, while a multitude of embodiments have been variously described herein, those of skill in this art will recognize that different embodiments show different potential features/designs which can be used in the other embodiments. Even more variations, applications and modifications will still fall within the spirit and scope of the invention, all as intended to come within the ambit and reach of the following claims.

What is claimed is:

1. A magnetic cleaning apparatus for a pipe, comprising:

a cylindrical-shaped major unit including a first end extending with taper to a second end, said first end comprises an open receptacle for storage of items and said second end comprises a first cavity; said first cavity and receptacle are separated by a horizontal separator formed integrally with said major unit; a master magnet is positioned within said first cavity at said second end of said major unit;

a first end cap positioned over said second end of said major unit securing said master magnet within said first cavity, wherein said second end of said major unit is placeable on an outside surface of the pipe;

a top cap removeably connected to said first end of said major unit to cover said receptacle within said major unit, said top cap and said first end cap are located on opposite ends of said major unit;

a cylindrical-shaped minor unit including a first end extending to a second end, said first end of the minor unit comprises a second cavity, a slave magnet is positioned within said second cavity at said first end of said minor unit;

a second end cap positioned over said first end of said minor unit securing said slave magnet within said second cavity, wherein said second end of said minor unit is placeable on an inside surface of the pipe, wherein said minor unit and said major unit adapted to maintain a magnetically coupled relationship when said major unit is moved along the outside surface of the pipe.

2. The magnetic cleaning apparatus of claim 1 further comprising a textured element disposed on said second end of said minor unit.

3. A magnetic cleaning apparatus for a pipe, comprising:

a cylindrical-shaped major unit including a first end extending to a second end, said first end comprises an open receptacle for storage of items and said second end comprises a first cavity; said first cavity and receptacle are separated by a horizontal separator formed integrally with said major unit; a master magnet is positioned within said first cavity at said second end of said major unit, a first end cap positioned over said second end of said major unit concealing said master magnet within said first cavity;

a top cap removeably connected to said first end wherein said top cap covers said receptacle within said first end of said major unit; said top cap and said first end cap are located on opposite ends of said major unit;

said second end of said major unit placed on an outside surface of the pipe;

a cylindrical-shaped minor unit including a first end extending to a second end, said first end of the minor unit comprises a second cavity, a slave magnet is positioned within said second cavity at said first end of said minor unit, a second end cap positioned over said first end concealing said slave magnet within said second cavity, said minor unit further comprising an textured element disposed on said second end;

said second end of said minor unit placed on an inside surface of the pipe, wherein said minor unit and said major unit adapted to maintain a magnetically coupled relationship when said major unit is moved along the outside surface of the pipe.

4. The magnetic cleaning apparatus of claim 3 wherein the textured element is nylon.

* * * * *